US007815331B2

(12) United States Patent
Chronopoulos

(10) Patent No.: US 7,815,331 B2
(45) Date of Patent: Oct. 19, 2010

(54) UMBRELLA LIGHTING APPARATUS

(76) Inventor: Ioannis Chronopoulos, 398 Bloor Street West, Toronto, ON (CA) M5S 1X4

( * ) Notice: Subject to any disclaimer, the term of this patent is extended or adjusted under 35 U.S.C. 154(b) by 154 days.

(21) Appl. No.: 12/098,733

(22) Filed: Apr. 7, 2008

(65) Prior Publication Data

US 2009/0251887 A1 Oct. 8, 2009

(51) Int. Cl.
*A45B 3/02* (2006.01)

(52) U.S. Cl. ..... 362/102; 362/577; 135/910

(58) Field of Classification Search ..... 362/102, 362/577, 23, 295, 652–659, 369; 135/15.1–48, 135/910

See application file for complete search history.

(56) References Cited

U.S. PATENT DOCUMENTS 5,053,931 A * 10/1991 Rushing ..... 362/102
6,439,249 B1 * 8/2002 Pan et al. ..... 135/16
6,666,224 B2 * 12/2003 Lee ..... 135/16
6,830,058 B2 * 12/2004 Li ..... 135/16

* cited by examiner

*Primary Examiner*—Gunyoung T Lee
(74) *Attorney, Agent, or Firm*—Fasth Law Offices; Rolf Fasth

(57) ABSTRACT

A lighting apparatus for attachment to an umbrella pole comprising, at least one arm having a first arm section, a second arm section, and a first hinged connection between a first end of said first arm section and a first end of said second arm section, an attachment means having a second hinged connection to a second end of said first arm section and securable to said umbrella pole, a connection means having a third hinged connection to a second end of said second arm section and slideably connected around the umbrella pole, and a lighting means on said at least one arm configured and disposed for illumination underneath said lighting apparatus wherein said hinge means, attachment means and connection means are configured and located to permit the at least one arm to move from an extended position away from the umbrella pole to a closed position substantially parallel to the umbrella pole.

7 Claims, 11 Drawing Sheets

UMBRELLA LIGHTING APPARATUS

FIELD OF THE INVENTION

This invention relates to a lighting apparatus. In particular, this invention relates to a lighting apparatus for attachment to an umbrella pole.

BACKGROUND AND DESCRIPTION OF THE PRIOR ART

A common problem that interferes with the enjoyment of the use of a patio umbrella is the lack of illumination under the patio umbrella canopy after dark. During daytime hours, patio or market umbrellas are a great way to create shade and atmosphere either in your own backyard, or on a restaurant patio. Evening relaxation, however, may pose an irritating problem. Even though the surrounding area may be well lit, the fabric or material of the umbrella casts a shadow below.

Various attempts have been made in the past to address the problem of lack of illumination under patio umbrellas.

Patio candles have been used to illuminate the underside of umbrellas in the dark by resting the candles on the patio tables. While these candles do provide a soft glow at night, they pose a safety hazard for use near small children. They also attract various insects, and require the constant attention of the patio table user to ensure that the flame is under control and that the wick is not burnt out.

U.S. Pat. No. 5,463,535 (Vest) teaches a tubular light that is secured around an umbrella pole. In order to open and close the umbrella, repeated removal and installation of the fixture is required. The fixture must then be stored in a safe place to avoid breakage. Since the tubular light takes the shape of the post, illumination is projected outward, not downward onto the tabletop where users would require the benefit of illumination. In addition, such outward illumination is not conducive to the individual enjoyment of a patio table, as having a light shining directly onto one's eyes would detract from the benefits of outdoor patio entertaining.

A major drawback of current lighting products is that they are not suitable to be used with non-standard umbrella poles. U.S. Pat. No. 5,584,564 (Phyle) teaches a system of elongated lights fastened to the ribs of an umbrella. The apparatus is only suitable for umbrellas with eight ribs, while the most popular umbrellas on the market have six. The use of this product is limited to only one specific application in which umbrellas have only eight ribs. Similarly, U.S. Pat. No. 7,080,925 (Rushing) teaches a plurality of miniature lights around the pole top of an umbrella. Though it may not obstruct any moving parts, the apparatus is only suitable for umbrellas with a specific number of ribs, namely umbrellas with six or eight ribs. U.S. Pat. No. 7,125,133 (Bilotti) teaches a system of elongated lights fastened to the ribs of an umbrella. The Bilotti apparatus relies on the support ribs of the umbrella to fasten the elongated lights. As umbrella and patio designs are constantly changing, the use of such lighting means taught by Phyte, Bilotti, and Rushing are not sufficiently flexible to meet the changing design needs.

U.S. Pat. No. 6,659,616 (Bilotti) and U.S. Pat. No. 6,851,823 (Billotti) disclose a battery powered lighting globe that is clipped to the side of an umbrella pole. In order to open and close the umbrella, removal and installation of the globe is required. The positioning of the globe results in light being obstructed through to the opposite side of the umbrella, thereby distributing light unevenly beneath the umbrella canopy.

U.S. Pat. No. 7,063,433 (Pape) discloses a convex dome secured around the pole of an umbrella. Just as with Bilotti above, in order to open and close the umbrella, removal of and installation of the lighting fixture is required.

There is a need for a lighting apparatus that will provide even light distribution underneath the canopy of an umbrella while providing ease of use that does not require the user to continuously assemble and disassemble the apparatus in conjunction with the opening and closing of the umbrella.

SUMMARY OF THE INVENTION

In one embodiment the present invention provides a lighting apparatus for attachment to an umbrella pole comprising, at least one arm having a first arm section, a second arm section, and a first hinged connection between a first end of said first arm section and a first end of said second arm section, an attachment means having a second hinged connection to a second end of said first arm section and securable to said umbrella pole, a connection means having a third hinged connection to a second end of said second arm section and slideably connected around the umbrella pole, and a lighting means on said at least one arm configured and disposed for illumination underneath said lighting apparatus wherein said hinge means, attachment means and connection means are configured and located to permit the at least one arm to move from an extended position away from the umbrella pole to a closed position substantially parallel to the umbrella pole.

The present invention provides a solution to the problem of providing lighting underneath an umbrella pole that is easy to use and that provides even and unobstructed light distribution for users as it does not require the user to have to remove or install the umbrella lighting fixture each time the umbrella is raised or lowered.

BRIEF DESCRIPTION OF THE DRAWINGS

In order that the invention may be more clearly understood, an embodiment thereof will now be described in detail by way of example, with reference to the accompanying drawings, in which.

DETAILED DESCRIPTION OF THE PREFERRED EMBODIMENTS

Figure 1:
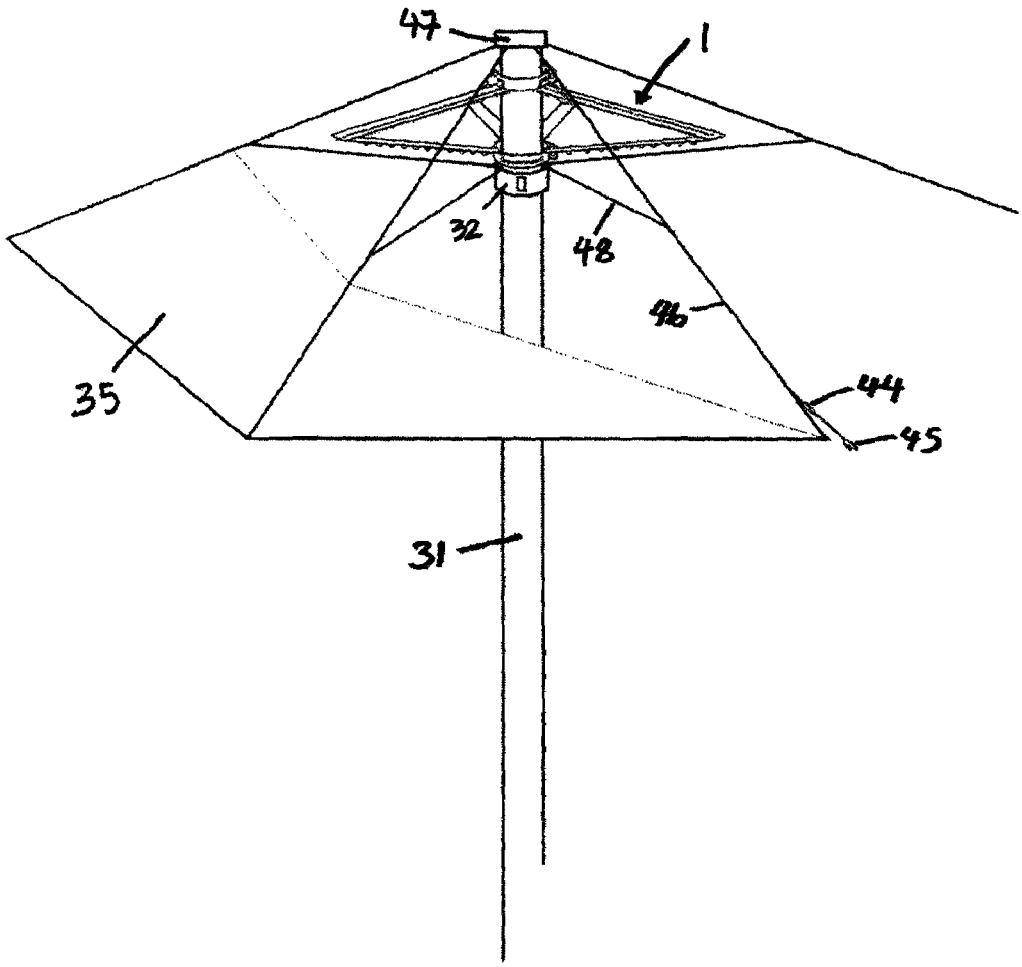
FIG. 1 is a perspective view of one embodiment of a lighting apparatus according to the present invention shown in an extended position in use with a patio umbrella.
Figure 2:
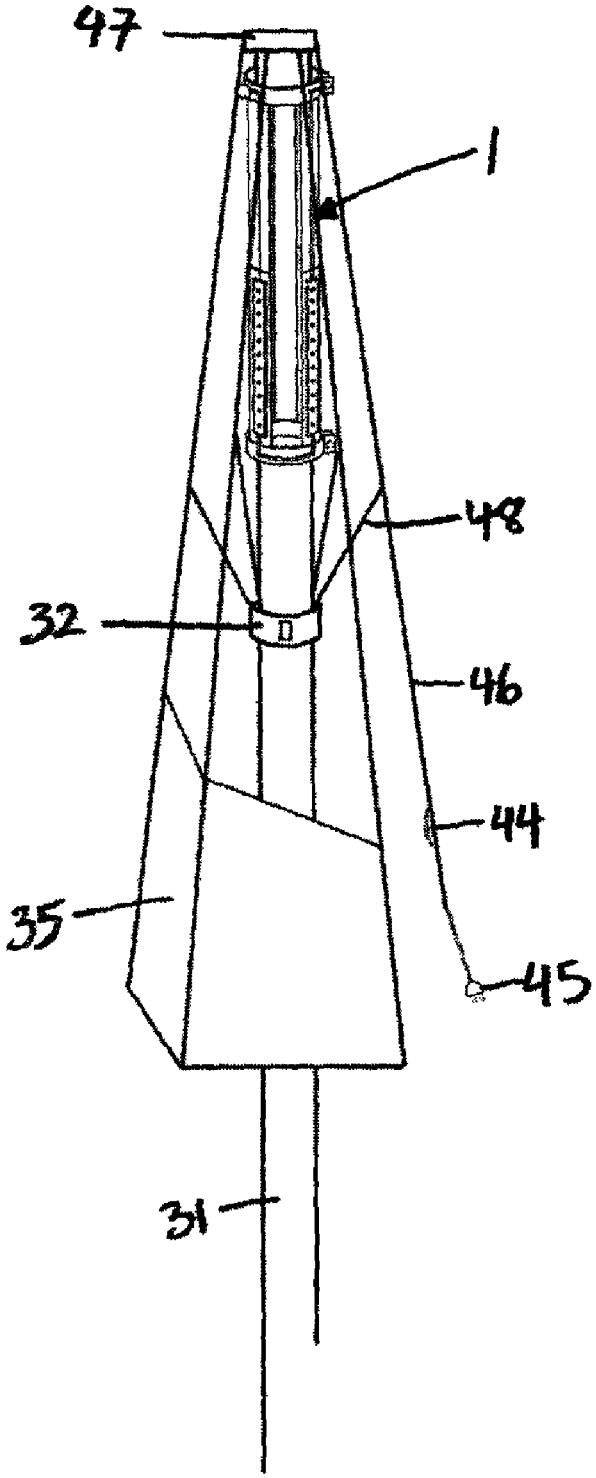
FIG. 2 is a perspective view of the lighting apparatus of FIG. 1 shown in the closed position in use with a patio umbrella.

One embodiment of a lighting apparatus for attachment to an umbrella pole according to the present invention is illustrated schematically in FIGS. 1 to 7*a* In the FIGS. 1 and 2 the lighting apparatus is shown attached to a typical patio umbrella pole. In FIGS. 3 to 7*a* the lighting apparatus is shown before attachment to an umbrella pole. As shown in FIGS. 1 and 2, the lighting apparatus, in the embodiment illustrated and generally indicated at 1, is adapted to fit on an umbrella pole 31 beneath an umbrella canopy 35 but above the locking slider 32 of the umbrella. In this position the lighting apparatus 1 of the present invention does not need to be removed or re-installed during opening and closing of the umbrella 35.

Figure 3:
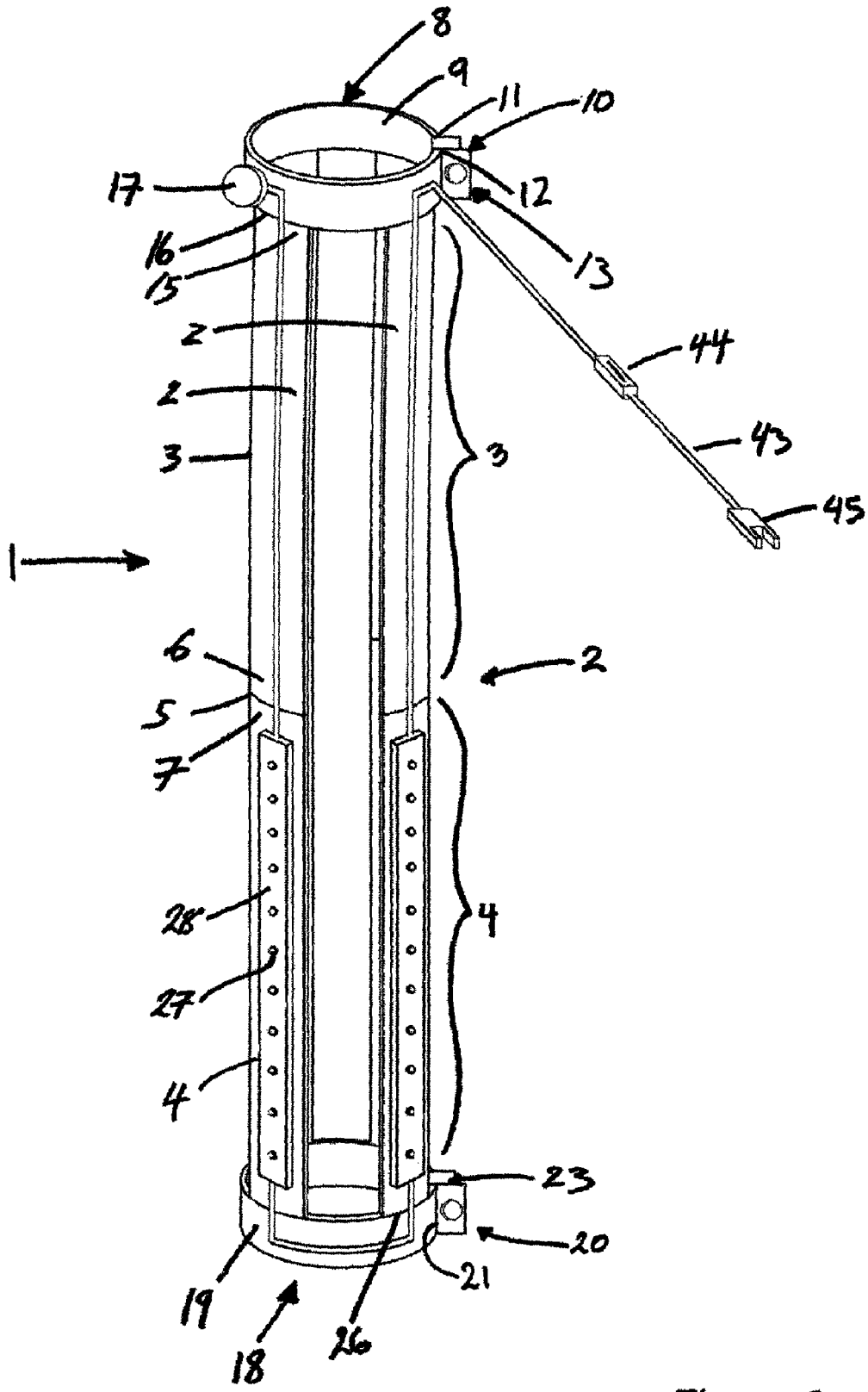
FIG. 3 is a perspective view of the lighting apparatus of FIGS. 1 and 2, shown in the closed position.
Figure 4:
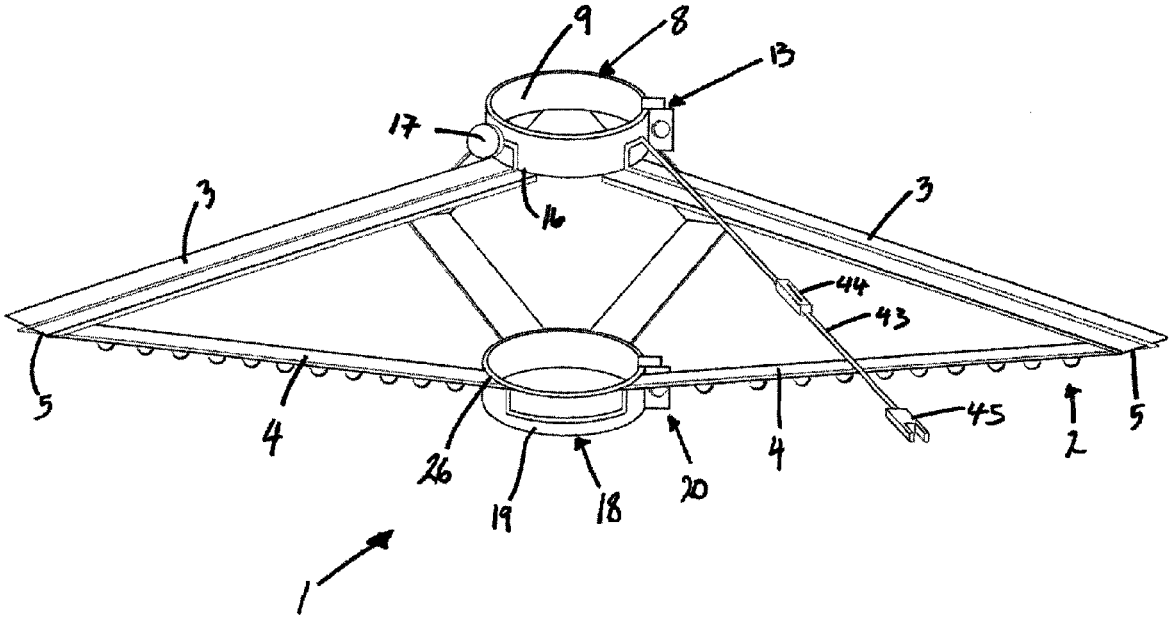
FIG. 4 is a perspective view of the lighting apparatus of FIG. 3, shown in the extended position.
Figure 5:
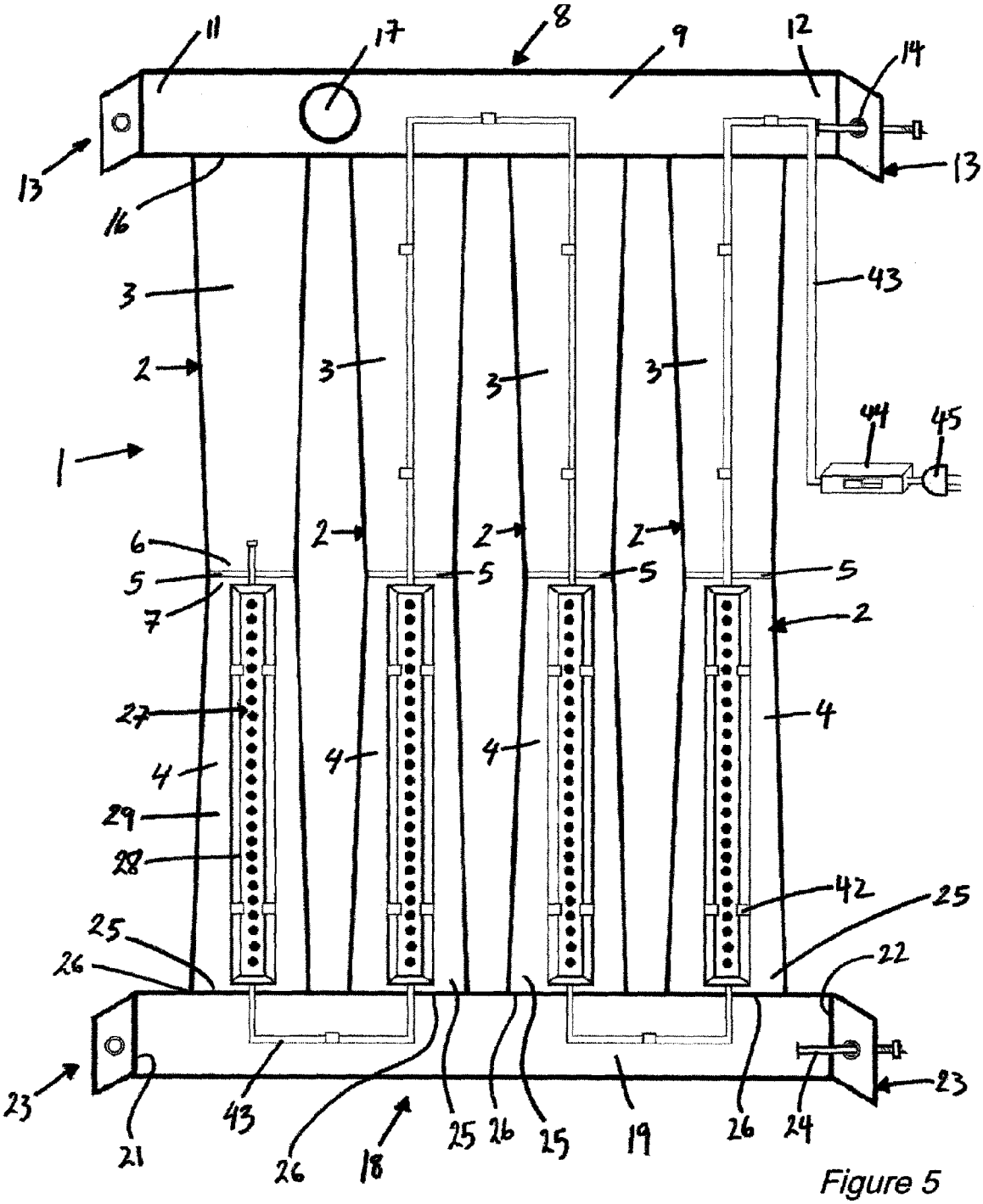
FIG. 5 is a plan view of the lighting apparatus of FIGS. 3 and 4 unrolled flat.

The lighting apparatus 1, as shown in FIGS. 3, 4 and 5 comprises at least one arm 2 having a first arm section 3, a second arm section 4, and a first hinged connection 5 between a first end 6 of said first arm section 3 and a first end 7 of said second arm section 4. In the embodiment shown, there are four arms 2, although it can be appreciated that the number of arms 2 can be either greater or lower than four and can be of varying thickness so that the number of arms present can be limited by the amount of space available on the apparatus. In the embodiment illustrated, the first arm section 3 and second arm section 4 comprises an elongated strip having sufficient rigidity to support lights mounted to the second arm section 4 when the first and second arm sections are in an extended position as shown in FIGS. 1 and 4. In the embodiment illustrated the first and second arm sections 3, 4 of each arm 2 are integrally formed from rigid material. The material joining opposing first ends 6, 7 of the first and second arm sections 3,4 is thinned to create a flexible first hinged connection 5.

An attachment means, generally indicated at 8, is configured and adapted to be secured to the umbrella pole 31 beneath the umbrella canopy 35. In the embodiment illustrated (best shown in FIGS. 3 and 4) the attachment means 8 has a body portion 9 with means, generally indicated at 10, for securing the body portion 9 to the umbrella pole. In the embodiment illustrated the ends 11, 12 of the body portion 9 have a clamp means generally indicated at 13 which together with an appropriate fastener 14 (see FIG. 5) are used to secure the body portion 9 to the umbrella pole. A second end 15 of each first arm section 3 is attached to the body portion 9 of the attachment means 8 by a second hinged connection 16. Once secured around the umbrella pole, the body portion 9 of attachment means 8 may be maintained in place by tightening set screw 17.

The lighting apparatus 1 includes connection means, generally indicated at 18, configured and adapted to be slideably connected around the umbrella pole 31 above the locking slider 32 of the umbrella 35. In the embodiment illustrated (best shown in FIGS. 3 and 4) the connection means 18 has a body portion 19 with means, generally indicated at 20, for securing the body portion 19 around the umbrella pole. In the embodiment illustrated the ends 21, 22 of the body portion 19 have a clamp means generally indicated at 23 which together with an appropriate fastener 24 (see FIG. 5) are used to secure the body portion 19 around the umbrella pole. A second end 25 of each second arm section 4 is attached to the body portion 19 of the connection means 18 by a third hinged connection 26. Once secured around the umbrella pole, the body portion 19 of connection means 18 may be moved back and forth along said umbrella pole towards the attachment means 8 which is fixed.

Lighting means generally indicated at 27 is attached on said at least one arm configured and disposed for illumination underneath said lighting apparatus. In the embodiment illustrated in FIGS. 3, 4 and 5 the lighting means 27 comprises a string of lights 28 attached to the outside surface 29 of the second arm section 4. The string of lights 28 is connected in series to the string of lights on adjacent arms 2 as shown in FIG. 5.

The first hinged connection 5, second hinged connection 16 on attachment means 8 and the third hinged connection 26 on connection means 18 are configured and located to permit the at least one arm to move from an extended position, as shown in FIG. 1, away from the umbrella pole to a closed position substantially parallel to the umbrella pole as shown in FIG. 2.

In the embodiment illustrated, the body portion 9 of attachment means 8 and the body portion 19 of connection-means 18 each have a length longer than the diameter of the umbrella pole 31. In the embodiment illustrated there are four arms 2 connected to the attachment means 8 and connection means 18 at equal intervals.

When installed on the umbrella pole 31, the attachment means 8 is secured against the top of the umbrella pole 31, while the connection means 18 is free to slide up and down the umbrella pole 31 unobstructed. The first arm section 3 and second arm section 4 are as noted above connected at their adjacent ends 6,7 by a hinged connection 5 allowing the arm 2 to extend outwards when the connection means 18 is pushed upward along the length of the umbrella pole 31 towards the attachment means 8.

When the umbrella is in the closed position (see FIG. 2), the attachment means 8 and the connection means 18 are at a maximum vertical distance from each other along the umbrella post 31, with the arms 2 straight and generally parallel relative to one another and the umbrella pole 31. As the umbrella is opened, the locking slider 32 of the umbrella upwardly pushes the connection means 18 towards the attachment means 8, resulting in the first arm section 3 and second arm section 4 of the arms 2 bending at the first hinged connection 5, second hinged connection 16 and third hinged connection 26 to extend the first arm section 3 and second arm section 4 of each arm 2 outwardly away from the umbrella pole. When the first arm section 3 and second arm section 4 of arms 2 extend outwardly they become orientated in a fashion relative to the umbrella pole 31, as shown in FIG. 1 and 4.

The attachment means 8 and connection means 18 can each have a clamp means 13, 20, as shown in FIG. 3. These clamp means 13,20 can vertically correspond with each other, in order to allow the lighting apparatus 1 to be disassembled and pulled apart to fit with the umbrella pole 31 for use. The attachment means 8 and connection means 18 can be wrapped around and secured about the umbrella pole 31 and tightened by a fasteners 14, 24 (see FIG. 5).

Figure 6:
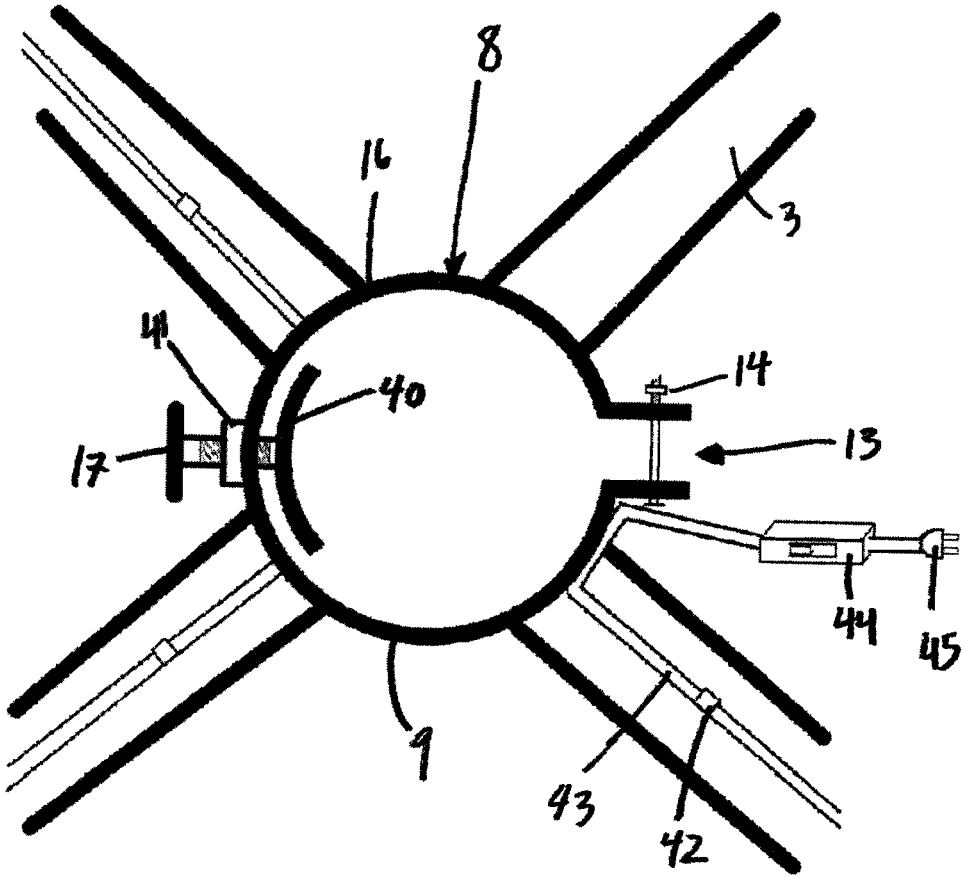
FIG. 6 is a top plan partial view of the first arm sections of lighting apparatus of FIG. 4 illustrating the adjustment and compression mechanism of the attachment means.

A top view of the lighting apparatus 1 in FIG. 6 demonstrates how the attachment means 8 contains a set screw 17 and inner rubber gasket 40 to secure the lighting apparatus 1 to the umbrella pole 31 and prevent any upward or downward movement relative to the umbrella pole 31. In the embodiment shown, the attachment means 8 has a threaded nut 41 embedded into the attachment means 8 that allows the set screw 17 to be screwed through to the inside of the body portion 9, which also connects to the rubber gasket 40. As the set screw 17 is then tightened, the rubber gasket 40 becomes compressed against the umbrella pole 31. In addition to providing a way to attach the lighting apparatus to the umbrella post 31, the attachment means 8 allows adjustment for accommodating a variety of pole diameters as the rubber gasket 40 can be of any shape, and is not limited to the convex shape shown. For example, with square shaped umbrella poles, the rubber gasket 40 can act as an adapter wherein its shape can conform to the dimensions of a square umbrella pole. This is but one example of how the present invention can be used with a variety of different umbrella poles.

Figure 7:
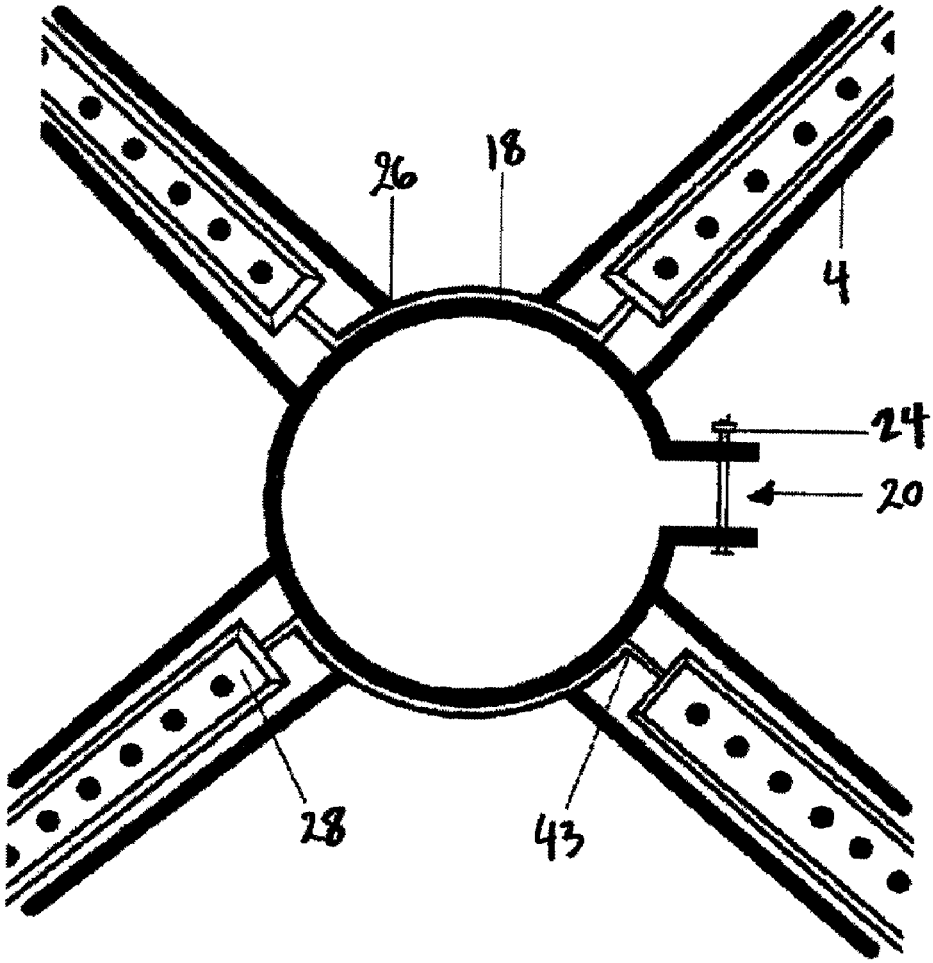
FIG. 7 is a bottom partial view of the lighting apparatus of FIG. 6 illustrating the connection means.
Figure 7A:
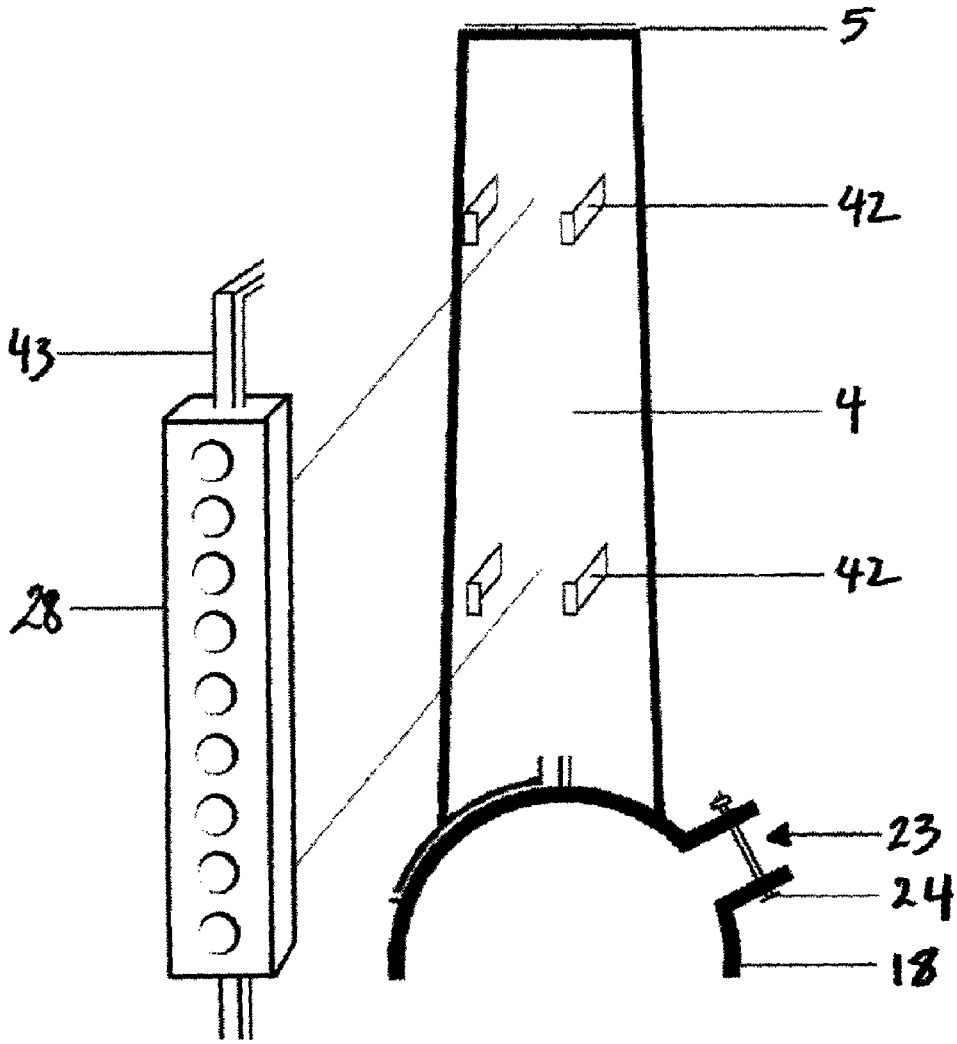
FIG. 7*a* is an exploded partial bottom view of the lighting apparatus of FIG. 7 and the second arm section.

As shown in FIGS. 3, 4, 5, and 7, the second arm section 4 has a lighting means 27 shown in this embodiment as an elongated lighting device 28 to provide illumination underneath the umbrella canopy. The lighting device 28 can be secured onto the second arm section 4 of the arms 2 by any securing means, such as through a snap-fit connection 42 as illustrated in FIGS. 5 and 7*a*. The lighting device 28 and lighting source can be connected in series by a power cord 43, along with a power switch 44 connected at a position upstream from the plug 45. FIG. 5 maps out how the power cord 43 enters at the arm 2 on one end 11 of the attachment means 8 and then weaves about the outside face of the arms 2 of the lighting apparatus 1 and stops short of the opposite end 12 of the attachment means 8, thereby allowing for an unobstructed passageway for ease of attachment to the umbrella pole 31.

Figure 6A:
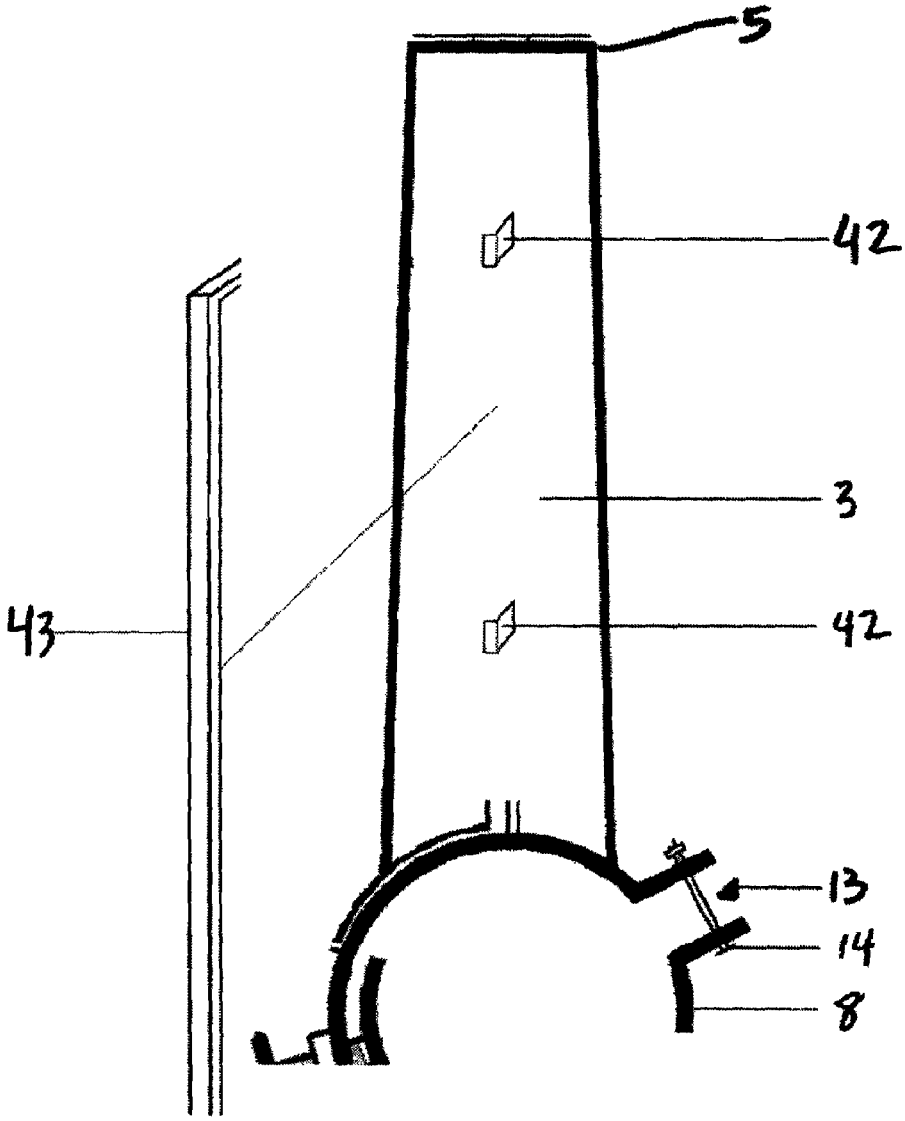
FIG. 6*a* is an exploded partial top view of the lighting apparatus of FIG. 4 with a power cord to be fitted to the first arm section.

The exploded view of the first arm section 3 of an arm 2 of the lighting apparatus 1 as shown in FIG. 6*a* illustrates how a power cord 43 can be connected by a snap fit connection 42 to the first arm section 4 of the arms 2 of the apparatus. Once affixed to the apparatus, the power cord 43 may then be plugged in to a power source either along the umbrella post 31 or outward along the umbrella rib 46 at the end of the canopy 35, as illustrated in FIG. 1. The power source can be of any known means, including electrical sources, battery packs, and solar panels as outlined in further detail below. It is further appreciated that the power cord 43 may also be attached by any means, including being screwed, glued, velcroed or cable-tied to the lighting apparatus 1.

As shown in FIG. 5, the power cord 43 is press fitted to the attachment means 8, such that the slack end of the power cord 43 will not travel up or down the umbrella pole 31 when the umbrella is opened or closed, thereby facilitating easier use of the apparatus with the umbrella.

Although the lighting device 28 can constitute a serendipitous elongated pattern weaving around the arms as described above and as shown in FIG. 5, it is appreciated that the lighting means can be provided in any way on the arms, including being wired in parallel and having lighting elements built within the arms. Because this lighting structure is intended for outdoor use, it is further appreciated that appropriate safety precautions will be taken to ensure that all components be resistant to water penetration.

Depending on the size of the umbrella, the distance between the umbrella top 47 and locking slider 32 shown in FIG. 1 may be greater for larger umbrellas. In order to support a longer rib 46, the gusset 48 would connect further outward along the rib 46, thus requiring a lighting apparatus that is longer in length to fit in the longer space between the umbrella top 47 and locking slider 32.

Figure 10:
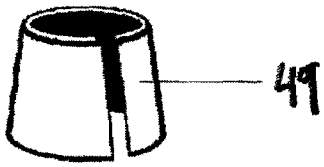
FIG. 10 is a perspective view of an optional spacer ring used with the lighting apparatus of the present invention.
Figure 12:
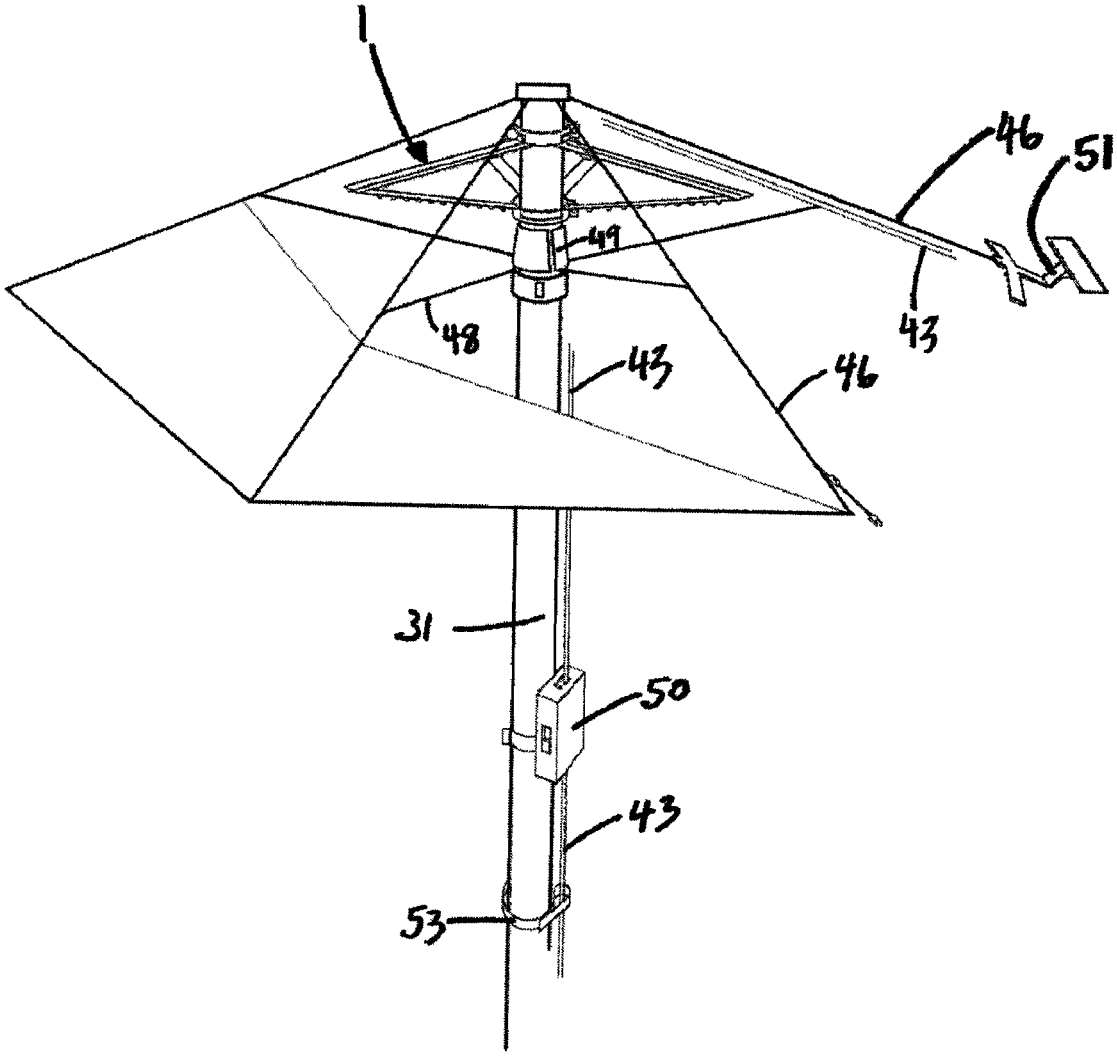
FIG. 12 is a perspective view of another embodiment of a lighting apparatus in accordance with the present invention shown in the extended position in use with a patio umbrella and all optional accessories shown in FIGS. 8-11.

FIGS. 10 and 12 illustrate how an optional spacer ring 49 may be installed below the connection means 18 and above the locking slider 32 in larger umbrellas. The spacer ring 49 can be of any shape, in addition to the funnel shape illustrated in FIGS. 10 and 12. The spacer ring 49 can be pulled apart just enough to receive the umbrella pole 31, then closed back to its original shape about the pole. By installing a spacer ring 49, the overall length of the fixture would be extended in order to push the connection means 18 higher up the umbrella pole 31, forcing the first arm section 3 and second arm section 4 of the arms 2 to remain perpendicular in relation to the umbrella pole 31 when the umbrella is opened.

Figure 8:
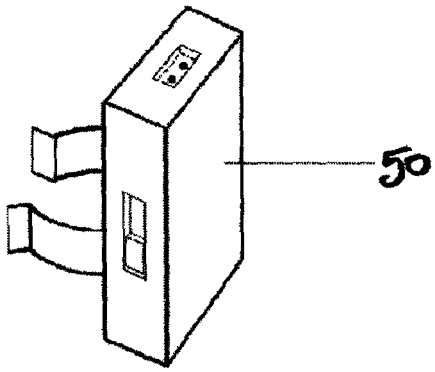
FIG. 8 is a perspective view of an optional battery pack used with the lighting apparatus of the present invention.
Figure 9:
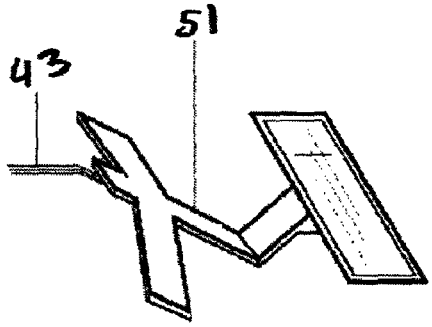
FIG. 9 is a perspective view of an optional solar panel used with the lighting apparatus of the present invention.
Figure 11:
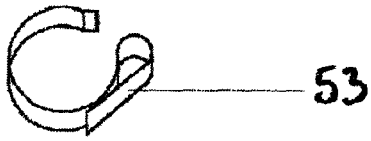
FIG. 11 is a perspective view of an optional pole cord clip used with the lighting apparatus of the present invention.

One option of a power source is a battery pack 50 as illustrated in FIGS. 8 and 12. The battery pack 50 can be fastened onto the umbrella pole 31, such as beneath the apparatus, or it can be fitted to a support rib 46. The battery pack 50 can be coupled to the power cord 43 or to a solar panel 51, as shown in FIG. 9, for re-charging. A cord clip 53 shown in FIGS. 11 and 12 may be installed onto a lower part of the umbrella pole 31 to hold the slack end of the power cord 43 taught to the pole to prevent unsightly and unsafe cord organization.

Another option for a power source is through attaching a solar panel 51 to the lighting apparatus in a manner that will capture and transmit solar energy. The solar panel 51 can be installed facing upward near the outer end of the support rib 46, as illustrated in FIG. 12. By positioning the solar panel on the exterior of the canopy of the umbrella, the exposed solar panel can charge the batteries regardless of whether the umbrella canopy is in the open and closed positions.

A Circuit Protection Device or GFI may also be installed in association with the lighting apparatus 1 to prevent electric shock.

An in-line switch 44 regulates power to the lights 28. A switch may also be placed in the body of the fixture itself 1, or on the battery pack 50. It would also be possible to incorporate a photocell, timer or dimmer switch (not shown) to turn the lights on and off automatically.

Installation of this umbrella lighting apparatus is simple, as the user can install the apparatus without the use of any tools. In order to affix the apparatus to the umbrella pole, the umbrella 35 should be opened about half way. The lighting apparatus 1 in its collapsed form (see FIG. 5) would be passed upward between the umbrella gussets 48 and placed below umbrella top 47 and above the locking slider 32. The clamp means 13 on attachment means 8 and the clamp means 20 on connection means 18 would be separated sufficiently to accept and surround the umbrella pole 31. Both clamp means 13, 20 would then be rejoined and the attachment means 8 (and in some embodiments, the connection means 18) would be hand tightened about the umbrella pole 31 using a fastener 14, 24.

The design of the apparatus lends itself well to adjustments designed by the user. As the attachment means 8 and the connection means 18 have a longer length than the diameter of the umbrella pole 31, the fixture can be rotated for final positioning and orientation prior to the final tightening and adjustments of the fasteners 14, 24. Also, with the umbrella 35 in the open position, the user can then reposition the fixture 1 so that the first arm section 3 and second arm section 4 of the arms 2 of the apparatus 1 can spread out between the gussets 48 or the support ribs 46, so as to prevent obstruction of the light by any part of the umbrella frame. The attachment means 8 can also be attached a distance away from the top of the support pole 47, such as one inch away, in order to prevent the fixture from touching or obstructing any part of the canopy or frame of the umbrella.

When the apparatus 1 has been properly aligned as desired by the user, the set screw 17 may then be tightened to secure the attachment means 8 into place.

The user has the option of attaching the slack end of the power cord 43 to one of two places. It may be fitted along the support rib 46 to the end of the canopy 35, or run downward along the umbrella pole 31 to be plugged in at ground level. The optional cord clip 53 can secure the power cord 43 to a lower part of the umbrella pole 31 for safety and aesthetic appearance.

A type of lighting device 28 that can be used with this application include Light Emitting Diodes (LED lights), florescent tubes, neon tubes, glow sticks, string lights, rope lights, light diffuser, or light emitters of any shape and size which can reasonably be adapted onto the lighting apparatus.

It may also be possible to have a lighting device 28 on both the first arm section 3 and second arm section 4 of the arms 2, in order to provide bi-directional illumination both down towards the ground and upwards towards the underside of the canopy 35. It may be desirable to project light towards the underside of the canopy 35 if the canopy is covered either entirely or in part with a reflective surface thereby creating the illusion of more light underneath the umbrella, which would be a more desirable result for evening illumination. The canopy can be of all shapes and sizes, including square shaped canopies having 4 ribs. In addition, fabricating the first arm section 3 and second arm section 4 of the arms 2 out of a translucent material such as clear or coloured Plexiglas would allow light to travel through the translucent material, in turn diffusing light below.

In order to secure the apparatus to the umbrella pole 31, a certain type of fastener 14, 24 through the clamp means 13, 20 on attachment means 8 and connection means 18 may be used. While the illustration in FIG. 6 shows a butterfly nut and bolt connection, it is appreciated that would be ideal, however a cheaper alternative could be a Cable Tie, Snap-Fit or any other fastener that would clamp the apparatus 1 about the supporting pole 31. In addition, the set screw 17 and inner gasket 40 may be interchanged with any similar compression device that would act to secure the attachment means 8 to the umbrella pole 31.

In order to produce a slender yet sturdy fixture, the material chosen for the apparatus must be lightweight yet rigid. While the most cost effective material at the present time would be plastic, as it could be produced from a mould or dye as one piece, it is appreciated that the apparatus can also be constructed out of metal wire, aluminium, Corplas or any other lightweight material.

Just as this apparatus can be prepared on a large scale for larger umbrellas, such as vendor cart umbrellas and the like, this apparatus can similarly be prepared on a small scale, for use with personal hand-held umbrellas or golf umbrellas.

Although various preferred embodiments of the present invention have been described herein in detail, it will be appreciated by those skilled in the art that variations may be made thereto without departing from the spirit of the invention.

What is claimed is:

1. A lighting apparatus for attachment to an umbrella pole comprising, at least one arm having a first arm section, a second arm section, and a first hinged connection between a first end of said first arm section and a first end of said second section, an attachment means having a second hinged connection to a second end of said first section and securable to said umbrella pole, a connection means having a third hinged connection to a second end of said second section and slideably connected around the umbrella pole, and a lighting means on said at least one arm configured and disposed for illumination underneath said lighting apparatus wherein said first hinged connection, attachment means and connection means are configured and located to permit the at least one arm to move from an extended position away from the umbrella pole to a closed position substantially parallel to the umbrella pole.

2. A lighting apparatus according to claim 1, wherein said attachment means is adapted to fit around and be secured in place on said umbrella pole.

3. A lighting apparatus according to claim 2, wherein said connection means is adapted to fit around and be secured around said umbrella pole so as to be able to slide up said pole towards and away the attachment means.

4. A lighting apparatus according claim 3, wherein said at least one arm, first hinged connection, attachment means and connection means are integrally formed.

5. A lighting apparatus according claim 4, wherein the first and second sections of the at least one arm is formed of a rigid material and the material joining opposing first ends of the first and second arm sections is thinned to create a flexible first hinged connection means.

6. A lighting apparatus of any one of claim 1, further comprising a multiplicity of arms and said lighting means is a serpentine elongated cord affixed to said multiplicity of arms.

7. A lighting apparatus of any one of claim 1, further comprising a multiplicity of arms and said lighting means is a solar panel attached to the umbrella.

* * * * *